United States Patent [19]

Barkan

[11] 4,045,633

[45] Aug. 30, 1977

[54] GAS-BLAST ELECTRIC CIRCUIT INTERRUPTER OF THE PUFFER TYPE

[75] Inventor: Philip Barkan, Media, Pa.

[73] Assignee: General Electric Company, Philadelphia, Pa.

[21] Appl. No.: 591,204

[22] Filed: June 27, 1975

[51] Int. Cl.[2] ..... H01H 33/70

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 2,459,599 | 1/1949 | Strom | 200/150 G |
| 3,733,452 | 5/1973 | Strippoli | 200/148 A |
| 3,940,583 | 2/1976 | Hertz | 200/148 A |
| 3,941,962 | 3/1976 | Thaler | 200/148 A |

*Primary Examiner*—Robert S. Macon

*Attorney, Agent, or Firm*—William Freedman

[57] ABSTRACT

A gas-blast interrupter of the puffer type comprises a piston positively connected to the movable contact rod of the interrupter and means defining a pumping space at one side of the piston containing gas compressed by piston motion during an opening operation. At the opposite side of the piston there is a working space in which compressed gas can act upon the piston to aid an opening operation. A blast passage is provided through which gas from the pumping space can flow into the arcing region. An auxiliary passage affords communication between this blast passage, and said working space.

Valve means effective during a low current interruption blocks flow through the auxiliary passage and allows free communication between the pumping space and the blast passage, whereby during a low current interruption, compressed gas from the pumping space can flow into the arcing region via the blast passage. The valve means is effective when pressure in the arcing region is high during high current interruptions: (i) to allow arcing products to flow through the auxiliary passage into the working space and (i.i.) to block free communication between the pumping space and the blast passage, thus decreasing contamination of gas in the pumping space and reducing pressure build-up therein.

11 Claims, 8 Drawing Figures

GAS-BLAST ELECTRIC CIRCUIT INTERRUPTER OF THE PUFFER TYPE

BACKGROUND

This invention relates to a gas-blast electric circuit interrupter of the puffer type and, more particularly, to an interrupter of this type in which the force required from an opening operator for operating the puffer device and separating the contacts of the interrupter during high-current interrupting operations is reduced.

The usual puffer-type circuit interrupter comprises a puffer device that is operated during an interrupting operation to compress arc-extinguishing gas, which is subsequently directed into the arcing zone to aid in arc extinction. In the typical puffer-type circuit interrupter, most of the force for operating the puffer device is derived from the same operator that is used for separating the contacts of the interrupter during the interrupting operation.

A problem usually encountered in such an interrupter is that the high-pressure arcing products produced during a high-current interruption act to oppose operation of the puffer device and to oppose separation of the contacts. More specifically, if the puffer device of such an interrupter comprises a piston positively coupled to the movable contact rod, then the high-pressure arcing products can develop opposing pressures ahead of the piston which can interfere both with operation of the piston and with opening of the contacts at the desired high speeds. One way of overcoming these opposing pressures is to provide an opening operator for the contacts and piston having a very high force output. Such an operator, however, can be quite expensive.

SUMMARY

Accordingly, an object of my invention is to construct a puffer-type, gas-blast interrupter in such a way that an opening operator with a relatively low force output can be relied upon for separating the contacts and operating the puffer device even at high currents when high-pressure arcing products are being developed.

Another object is to provide a puffer-type interrupter in which the pressurized gas in the puffer device used for arc-extinguishing purposes is not significantly contaminated by arcing products and in which any opposition to puffer-device operation and to contact-separation developed by the arcing products during high current interruptions is substantially reduced.

Still another object is to utilize the high pressure arcing products developed during high-current interruptions to aid in operating the puffer device.

In carrying out the invention in one form, I provide a gas-blast interrupter of the puffer type comprising separable contacts, one of which is movable relative to the other to effect contact-separation and produce an arc therebetween in the region between the contacts. A piston is positively connected to said one contact and is slidably received within a cylinder containing a pumping space at one side of the piston adapted to contact arc-extinguishing gas that is compressed by motion of the piston during a contact-separating operation. The cylinder also contains a working space at the opposite side of said piston in which pressurized gas can act upon the piston in a direction to aid contact-separating motion of said one contact. The interrupter further comprises a blast passage extending from said pumping space to said arcing region via a path effectively bypassing said working space, through which gas compressed in said pumping space can flow into the arcing region to aid in extinguishing the arc. Auxiliary passage means affords communication between said blast passage and said working space. Valve means is provided which is effective during a low-current interruption to block flow through said auxiliary passage and to allow free communication between said pumping space and said blast passage, whereby during a low-current interruption, compressed gas from said pumping space can flow into said arcing region via said blast passage. The valve means is effective when the pressure in the arcing region is high during high-current interruptions: (i) to allow flow through the auxiliary passage so that during this part of a high-current interruption arcing products can increase the pressure in said working space and (ii) to block free communication between said pumping space and said blast passage, thereby decreasing contamination of the gas in said pumping space by said products and reducing pressure build-up in said pumping space by said arcing products.

BRIEF DESCRIPTION OF DRAWINGS

For a better understanding of the invention reference may be had to the accompanying drawings, wherein.

DETAILED DESCRIPTION OF PREFERRED EMBODIMENTS

Figure 1:
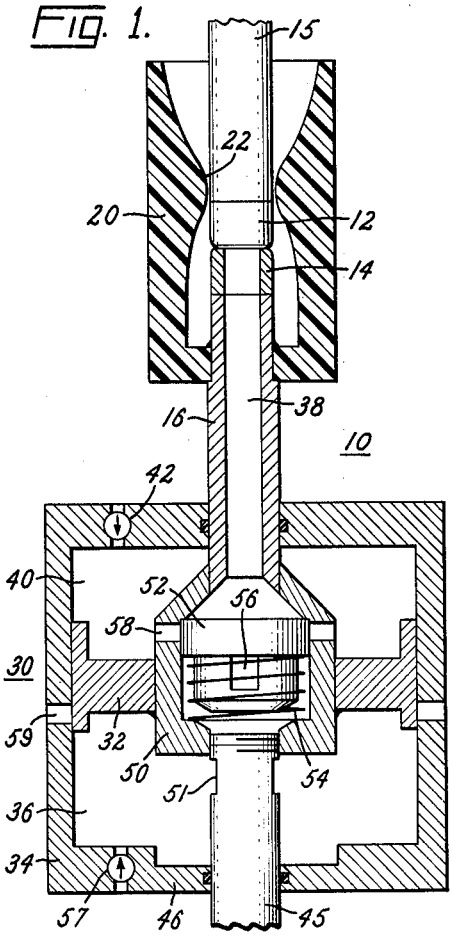
FIG. 1 is a side elevational view, mostly in section, showing an interrupter embodying one form of my invention.

Referring now to FIG. 1, there is shown a puffer-type circuit interrupter 10 that is located within a conventional housing (not shown) that is filled with a moderately pressurized arc-extinguishing gas, such as sulfer hexafluoride at a pressure of about 60 p.s.i. This gas surrounds the interrupter and is normally present within all open spaces within the interrupter.

The interrupter comprises a first contact 12 that is generally stationary and a second contact 14 that is vertically movable with respect to the first contact. In the illustrated embodiment of FIG. 1, contact 12 is mounted on a stationary rod 15 and contact 14 is an annular member mounted on a tubular movable contact rod 16. A tubular nozzle 20 of insulating material surrounds the contacts 12 and 14 and is shown mounted on contact rod 16 for movement therewith. The nozzle has a restricted throat 22 that closely surrounds the stationary contact 12 and its support rod 15.

Opening of the circuit interrupter is effected by driving the contact rod 16 downwardly by suitable means (not shown), thereby separating contacts 12 and 14 and developing an arc therebetween. During high current interruptions, a relatively large volume of arcing products is developed in the arcing region between the contacts as a result of vaporization of contact material and of nozzle material by the high current arc. These arcing products are exhausted upwardly through the throat 22 but only to a very limited extent while the throat remains around the contact 12 since the contact 12 is then generally blocking flow through the throat. However, after a predetermined initial downward motion of contact rod 16 and the nozzle 20, the throat 22 is unblocked and arching products are free to exhaust therethrough. The pressure developed in the arcing region by these arcing products varies in magnitude directly with the magnitude of the current.

To aid in extinguishing the inter-contact arc, both during high current and low current interruptions, a puffer device 30 is provided. This puffer device comprises a piston 32 positively coupled to the contact rod 16 and a stationary cylinder 34 in which the piston is slidably mounted. At the lower side of the piston 32, the cylinder contains a pumping space 36 in which gas is compressed by downward motion of the piston during a circuit-interrupter opening operation. At a predetermined point in the opening stroke, this compressed gas is allowed to flow from the pumping space 36 into the arcing region via a blast passage 38 extending upwardly through the contact rod 16 and contact 14, assuming that the pressure in the arcing region is not then so high as to block such flow.

Above the piston 32 there is a working space 40 within cylinder 34 where pressurized gas will act upon the piston 32 in a direction to aid contact-separating motion of contact rod 16 and contact 14. A passage containing check valve 42 allows pressurized gas from the surrounding ambient to flow into working space 40 when the piston 32 is moved downwardly during an opening operation, assuming a low-current interruption, during which there is no pressure build-up in this space, as will soon be explained.

Opening force is transmitted to contact rod 16 through an operating rod 45 that extends in sealed relationship through the lower end wall 46 of the cylinder 34. The upper end of operating rod 45 is joined to a hollow valve housing 50, which, in turn, is joined to piston 32 and movable contact rod 16. The upper end of the operating rod 45 is hollow and has ports 51 therein that afford communication between the interior of valve housing 50 and the working space 36 beneath piston 32.

Within the hollow valve housing 50 there is a vertically-movable valve member 52 of cup shape. A compression spring 54 biases valve member 52 in an upward direction, normally holding it in its position of FIGS. 1 and 2 with respect to the valve housing. The valve member 52 has a plurality of radially-extending passages 56 in its cylindrical wall through which gas can flow through the valve when the valve member is in its position of FIGS. 1 and 2. The valve body 50 contains a plurality of radially-extending ports 58 that are blocked off by the cup-shaped valve member 52 when in its position of FIGS. 1 and 2.

When the pressure above valve member 52 exceeds that below it by a predetermined minimum value, the value member 52 moves downwardly with respect to valve housing 50, thereby opening the ports 58 and effectively closing the passages 56. Such effective closing of passages 56 occurs when the conical surface 60 of the valve member engages conical valve seat 62 of the valve housing at the end of such downward motion.

During a low-current interrupting operation, the pressure above the valve member 52 does not appreciably exceed that below it, and the valve member thus remains in its position of FIG. 1 with respect to valve housing 50. During the initial portion of such low-current interrupting operation, the throat 22 of the nozzle 20 is effectively blocked by contact 12, as above described, and little upward flow takes place past valve member 52. But when the throat is unblocked by further downward movement of contact rod 16 and nozzle 20, the gas compressed in cylinder space 36 beneath piston 32 is free to flow upwardly past the valve member 52 into the blast passage 38 and the inter-contact arcing region, thus producing the desired arc-extinguishing effect.

During a high-current interrupting operation, the high pressures developed in the arcing region are quickly transmitted to the top of valve member 52, forcing it downwardly into its closed position where surfaces 60 and 62 engage. Valve member 52 thus acts in the manner of a check valve element, permitting flow upwardly from pumping space 36 through the valve 50, 52 but blocking flow downwardly into the pumping space through the valve 50, 52. After the throat 22 of the nozzle 20 has been unblocked, as above described, upward flow of gas from the pumping space 36 into the arcing region during high-current interruptions occurs on an intermittent basis. More specifically, during high-current interruptions, such upward flow occurs only during the interval around current zero, which is an interval when the pressure in the arcing region is relatively low due to the relatively low valve of the instantaneous current. During the remainder of the current wave, when the instantaneous value of current is high, high pressures are present in the arcing region, thus blocking movement of valve member 52 out of its closed position. The above-described flow during the period around current zero is an important characteristic of a puffer-type gas-blast circuit breaker which contributes importantly to its high-current interrupting ability.

Opening the ports 58 in response to the high pressures developed by arcing products during high-current interruptions serves several highly desirable purposes. First, such opening of ports 58 makes available an added expansion chamber for these arcing products (in the form of working space 40), thus assisting in purging the arcing region and reducing the likelihood of harmful overpressures. Second, such opening of ports 58 allows the high-pressure arcing products to enter working space 40 and increase the pressure therein, thus applying a downward force on piston 32 which assists the opening operator in separating the contacts and in performing the desired compression of gas beneath piston 32.

Several important advantages are attained by effectively closing the valve 50, 52 with respect to pumping chamber 36 in response to the pressures of high-current interruption. One such advantage is that the contaminated arcing products are not permitted to enter the pumping space 36 in any significant quantity. Accordingly, the pressurized gases flowing upwardly from the pumping space 36 during the period around current zero during high-current interruptions, as above described, are relatively clean and of the desired high dielectric strength needed to facilitate interruption.

It should be noted that while the gases in the pumping space 36 are kept relatively uncontaminated due to the action of valve member 52, the gases in working space 40 above the piston are relatively highly contaminated in view of the above-described entry of arcing products thereinto via ports 58 when valve member 52 is in its depressed, closed position. The gases in working space 40, however, are not allowed to flow back into the arcing region during the period around current zero because the valve member 52, in returning to its open position at this time, closes off ports 58 and thus blocks communication between the working space 40 and the arcing region. Accordingly, the action of valve member 52 allows me to collect contaminated arcing products in space 40 without permitting these products to be returned to the arcing region at an undesired time.

It will be clearly apparent that the blast passage 38, in extending from the pumping space 36 to the arcing region, effectively bypasses the working space 40 above piston 32; and thus flow can take place from the pumping space 36 into the arcing region via the blast passage without contamination from any arcing products then collected in the working space 40.

Another important advantage derived from valve 50, 52 is that the valve, by effectively preventing entry of high-pressure arcing products into the pumping space 36 during high current interruptions, prevents these arcing products from building up pressure in this space that will stall downward motion of the piston 32. This feature is important not only because such pressures could interfere with the desired operation of the puffer device in compressing the clean gases within space 36 but, even more so, because such pressures oppose opening motion of the contact rod 16 and could even stall such opening motion at very high currents if the valve 50, 52 were not present. It is possible to overcome this latter problem by providing an opening operator with a very high force output, but such operators are quite expensive. I am able to rely upon a less expensive operator with a much lower force output because of the above-described action of my valve 50, 52 in preventing such a build-up of opposing pressures in pumping space 36.

It will be noted that in my circuit interrupter, the pumping piston 32 is positively coupled to the contact rod 16. In a circuit interrupter that has such a positive coupling, which is typical of a puffer-type gas-blast circuit interrupter, it is especially important to prevent stalling of the piston during opening because such piston-stalling results in stalling of contact-separation. This relationship between piston and movable contact should be distinguished from that present in certain oil circuit breakers, where the pumping piston is not positively coupled to the contact rod and can be stalled without stalling contact-separation.

Near the end of an opening operation, the contaminated gases that have collected above piston 32 in the working space 40 during a high-current interruption are vented from this space 40 through vent ports 59 in the cylinder 34. Until near the end of the opening operation, these vent ports 59 are covered and substantially blocked by the rim of piston 32. But near the end of the opening operation, the piston 32 has moved downwardly sufficiently to uncover these vent ports 59, thus allowing gases collected in working space 40 to be vented through the vent ports to the surrounding ambient.

Closing of the interrupter is effected by driving the operation rod 45 upwardly from its open position into its closed position of FIG. 1. To assure satisfactory filling of the pumping space 36 during a closing operation of the circuit interrupter, a check valve 57 is provided in the lower end wall of the cylinder 34. Even if the main valve 50, 52 should close near the end of a closing operation, gas from the surrounding ambient is free to enter pumping space through this check valve 57.

Before the final portion of a closing stroke, it is desirable to purge the inter-contact region of contaminated gas which may have remained behind from a prior interruption and to build up added pressure in this region. Such purging and added pressure reduce the chance for an objectionable prestrike between the contacts. FIG. 2*a* illustrates a valve construction which can function to facilitate such purging and pressurization. This valve differs from that of FIG. 1 primarily in having its upper annular valve seat 68 spaced radially inward from the outer periphery of movable valve member 52, thus allowing the pressurized gas in working space 40 to exert a downward force on the movable valve member 52 even when the valve member is in its uppermost position, shown in FIG. 2*a*. During a closing operation, when piston 32 moves upwardly within cylinder 34, the piston compresses gas in the upper cylinder space 40 while reducing pressure in the lower cylinder space 36. This pressure differential acting on the upper face of movable valve member 52 outside seat 68 forces the valve member downwardly against spring 54. This unblocks ports 58, allowing pressurized gas in cylinder space 40 above the upwardly-moving piston to flow through ports 58 into blast passage 38 and upwardly through passage 38 into the inter-contact region. This flow in the inter-contact region helps to purge it of contaminated gases and to pressurize it, thus reducing the chance for an objectionable pre-strike during closing. While the presence of throat 22 around stationary contact structure 12, 15 during this interval does impede the above-described flow through the inter-contact region, sufficient leakage occurs through the throat to allow significant purging flow. The pressure of the throat 22 around the stationary contact structure 12, 15 during this interval promotes the desired pressure build-up in this region during the final stages of closing.

Figure 3:
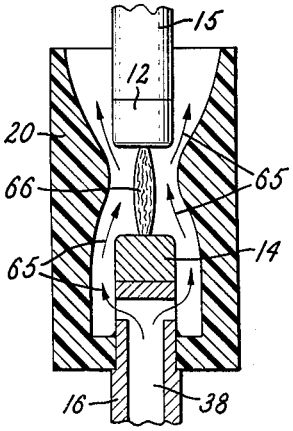
FIG. 3 is a sectional view of another modified form of interrupter.

Although I have shown in FIG. 1 a particular nozzle and contact arrangement, it is to be understood that my invention in its broader aspects is not limited to such arrangement. For example, in FIG. 3 there is shown a nozzle and contact arrangement of a generally conventional design wherein the blast passage 38 exhausts radially into the bore of the nozzle at a location spaced from the arcing region, and the blast therefrom is in an axial direction in the arcing region, as indicated by arrows 65. An arc 66 is shown between contacts 12 and 14 in the arcing region.

Figure 4:
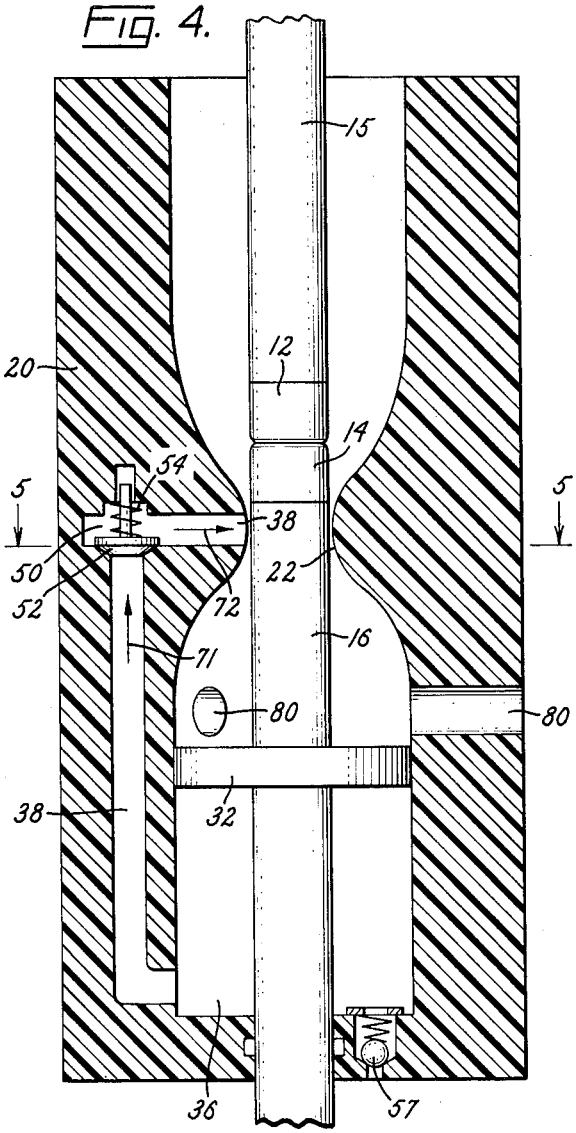
FIG. 4 is a side elevational view mostly in section of another modified form of interrupter. The section is along the line 4—4 of FIG. 5.
Figure 5:
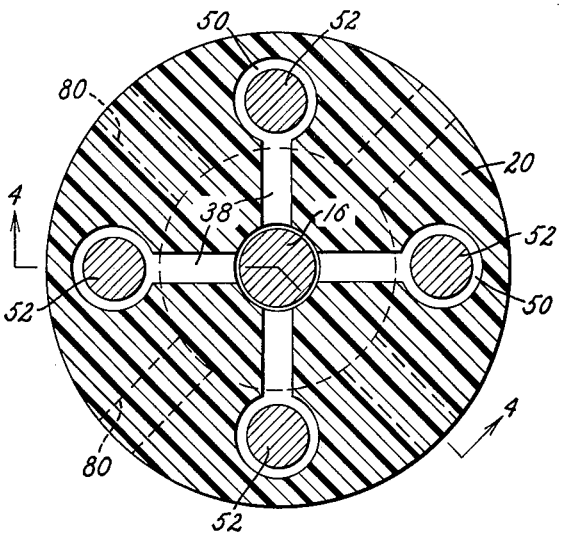
FIG. 5 is a sectional view along the line 5—5 of FIG. 4.

Sitll another form of my invention is shown in FIGS. 4 and 5. In this embodiment, stationary contact 12 is supported on a stationary rod 15, and movable contact 14 is supported on a movable contact rod 16. Insulating nozzle 20 is a stationary member comprising a restricted throat 22 closely surrounding movable contact rod 16. A plurality of blast passages 38 enter the throat region in a radial direction, but their mouths are effectively blocked by movable contact structure 14, 16 when the interrupter is in its closed position of FIG. 4.

A puffer piston 32 is positively connected to the movable contact rod 16 and is slidably received within the bore of nozzle 20 so that the lower portion of the nozzle serves as a cylinder around piston 32. Beneath piston 32 there is a pumping space 36 in which arc-extinguishing gas is compressed by downward motion of piston 32. The blast passages 38 (only one of which is shown in FIG. 4) communicate at their lower ends with this pumping space 36, thus extending between the arcing region and the pumping space 36 via paths effectively bypassing the working space above the piston.

A check valve 50, 52 is located in the blast passage 38 for allowing pressurized gas to flow only in the direction of arrows 71 and 72. This check valve comprises a movable valve member 52 that is biased by a spring 54 into its closed position of FIG. 4. Only when the pressure beneath valve member 52 exceeds the pressure above it by a predetermined minimum amount does the valve open to allow flow therethrough.

When the contact rod 16 is driven downwardly to open the interrupter, the blast passage 38 is effectively blocked by movable contact structure 14, 16 until the movable contact structure clears the throat 22. During this initial opening period, piston 32 compresses arc-extinguishing gas in space 36. When blast passage 38 becomes unblocked, pressurized arc-extinguishing gas flows through the illustrated passages 38 into the arcing region, assuming that the pressure in this arcing region is then low enough to allow such flow.

The check valve 50, 52 of FIG. 4 prevents high pressure arcing products from reverse flowing through blast passage 38 into pumping space 36, thus reducing contamination of the pumping space by arcing products and also preventing arcing products from producing a pressure build-up in the pumping space which could block puffer operation or contact separation. The pressurized arcing products are able to act on the top of pumping piston 32 once the contact structure 14, 16 unblocks throat 22, thus aiding the opening operation.

Suitable radially-extending exhaust ports 80 are provided in the lower portion of nozzle 20 above piston 32 to allow arcing products flowing downwardly to exhaust from the nozzle. These exhaust ports limit the pressure build-up above piston 32, but the limited pressure build-up that does occur aids the contact-separating action.

Figure 2:
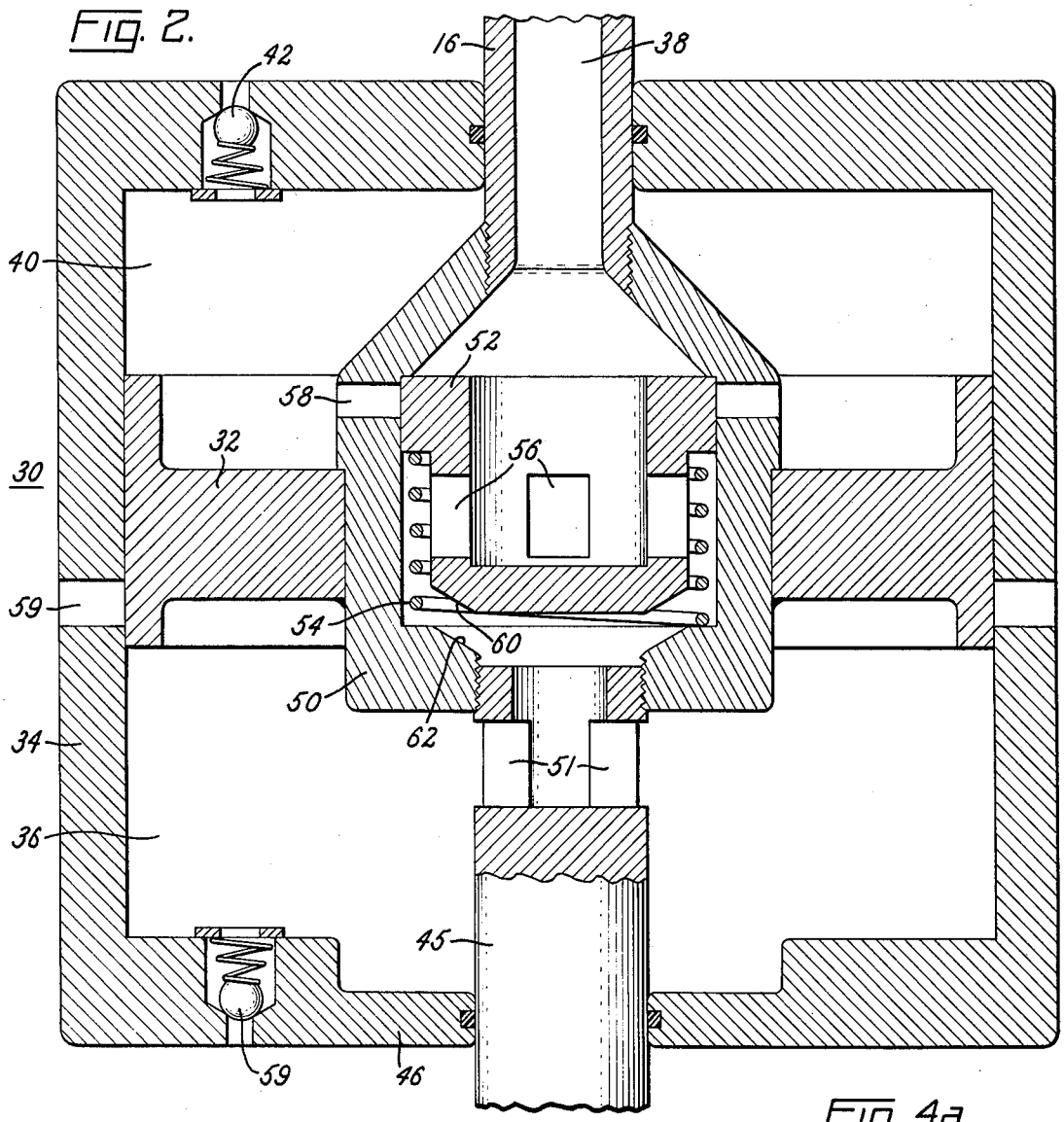
FIG. 2 is an enlarged view of a portion of FIG. 1.
Figure 2A:
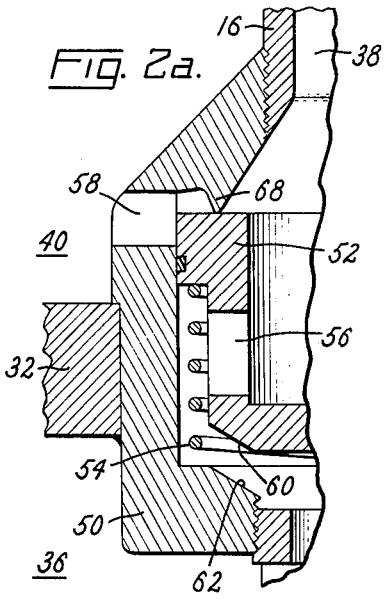
FIG. 2*a* is a view similar to that of FIG. 2 except showing a modification of FIG. 2.

A disadvantage of the arrangement of FIG. 4 over that of FIG. 2 is that there is no valve action in the interrupter of FIG. 4 to prevent return flow of arcing products collected above the piston into the inter-contact arcing region, as by the blocking of ports 58 in FIG. 2. But such collection and return flow of arcing products is limited in FIG. 4 by virtue of the venting that occurs through exhaust ports 80. This venting, of course, limits the extent to which pressure can build up above piston 32 to aid in developing contact-opening force, as was mentioned above.

In the arrangement of FIGS. 1 and 2, if the pressure build-up above piston 32 is not required to provide supplemental force to aid in the opening operation, one or more large openings can be provided in the upper wall of cylinder 34 to provide for free communication between space 40 and the surrounding ambient. Such openings would function in a manner similar to ports 80 in FIG. 4.

Figure 4A:
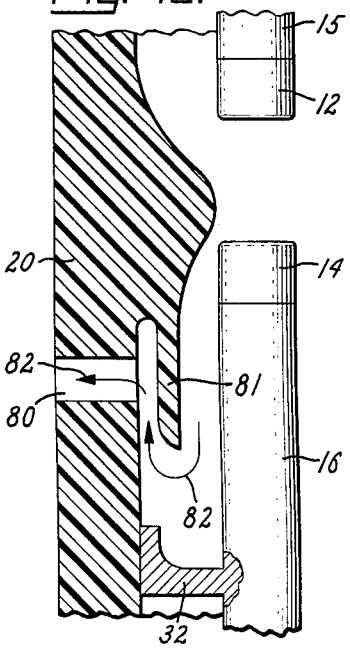
FIG. 4*a* shows a modification of the interrupter of FIG. 4, the interrupter being depicted while passing through a partially-open position.

In FIG. 4 the downward flow of arcing products from the arcing region through exhaust ports 80 does result in a transfer of momentum from the gas to the piston 32, and this accelerated downward movement of the piston. This momentum transfer can be promoted by providing the piston with a concave top surface as shown in FIG. 4*a* and by providing an annular vane 81 extending downwardly past exhaust ports 80 toward the cavity atop the piston. The vane and the cavity cooperate to force the downwardly-flowing gas into more direct impingement with the upper piston surface and to force a reversal in the direction of such flow following this impingement. Arrows 82 show the path of the gas as it flows in the region of the piston.

Figure 6:
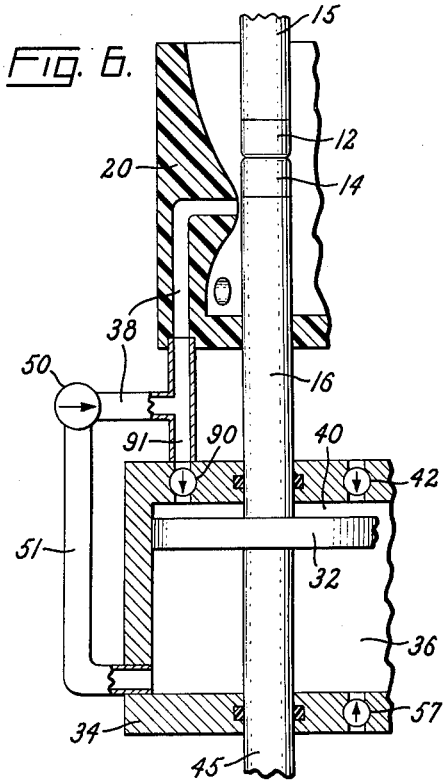
FIG. 6 is a side elevational view mostly in section of still another modified form of interrupter.

FIG. 6 illustrates another embodiment of the invention, which embodiment has certain features corresponding to those in FIG. 1 and certain corresponding to those in FIG. 4. The pumping piston 32 of FIG. 6 is located in a separate cylinder 34, as in FIG. 1, and the pumping space 36 beneath the piston communicates with the arcing region via a blast passage 51, 38 that effectively bypasses working space 40 above the piston 32 and exhausts radially into the arcing region, as in FIG. 4. Pressurized gas compressed in pumping space 36 can flow upwardly through blast passage 51, 38 into the arcing region under the same condition as described with respect to FIGS. 1 and 4. At the end of blast passage 51, 38 of FIG. 6 there is a first check valve 50 that prevents high-pressure arcing products developed in the arcing region from flowing into pumping space 36 via conduit portion 51 of the blast passage. These high-pressure arcing products are free to flow into the working space 40 above the piston 32 via an auxiliary passage 91 but are blocked by a second check valve 90, located in auxiliary passage 91, from exhausting from the working space 40 into blast passage 38 during interruption.

The first check valve 50 of FIG. 6 acts in generally the same manner as the check valves in the other embodiments to prevent the arcing products from contaminating the arc-extinguishing gases in the pumping space 36 and from building up objectionable operation-opposing pressures beneath pumping piston 32. The second check valve 90 prevents the contaminated gases collected in working space 40 from reverse flowing into the arcing region during periods of low pressure therein, as would occur near current zero, thereby preventing these gases in space 40 from interfering with interruption.

The check valve 90 is set to allow flow downwardly therethrough into working space 40 only when the pressure thereabove exceeds that therebelow by a predetermined value. This value is sufficiently high to prevent such downward flow during low current interruptions, thus forcing substantially all of the gas flowing from pumping space 36 upwardly through blast passage 51, 38 under these conditions to flow into the arcing region, without significant diversion of such gases into working space 40.

FIG. 6 illustrates that the functions described in the immediately preceding paragraph can be performed by two separate check valves instead of the single valve described in connection with FIG. 2.

While I have shown and described particular embodiments of my invention, it will be obvious to those skilled in the art that various changes and modifications may be made without departing from my invention in its broader aspects; and I, therefore, intend in the appended claims to cover all such changes and modifications as fall within the true spirit and scope of my invention.

What I claim as new and desire to secure by Letters Patent of the United States is:

1. A gas-blast electric circuit interrupter of the puffer type comprising:

a. a pair of separable contacts, b. means operable during circuit-interruption for moving one of said contacts relative to the other to separate said contacts and produce an arc therebetween in the region between said contacts, said arc developing arcing products varying in pressure generally as a direct function of the arcing current, c. a piston positively coupled to said one contact, d. means cooperating with said piston for defining:

$d_1$. a pumping space at one side of said piston adapted to contain arc-extinguishing gas that is compressed by motion of said piston during a contact-separating operation and $d_2$. a working space at the opposite side of said piston from said pumping space in which pressurized gas is adapted to act upon said piston in a direction to aid contact-separating motion of said one contact, e. means defining a blast passage through which gas compressed in said pumping space can flow into said arcing region to aid in extinguishing said arc, said blast passage extending from said pumping space to said arcing region via a path effectively bypassing said working space, f. auxiliary passage means affording communication between said blast passage and said working space, g. and valve means effective during a low-current interrupting operation:

$g_1$. to block flow through said auxiliary passage means and $g_2$. to allow free communication between said pumping space and said blast passage, whereby during a low-current interrupting operation compressed gas from said pumping space can flow into said arcing region via said blast passage at a predetermined point during contact-separation, h. said valve means being effective when the pressure of said arcing products in the arcing region is high during a high-current interrupting operation:

$h_1$. to allow flow through said auxiliary passage means into said working space, whereby during a high-current interrupting operation arcing products can increase the pressure in said working space, and $h_2$. to block free communication between said pumping space and said blast passage, thereby decreasing contamination of the gas in said pumping space by said arcing products and reducing pressure build-up in said pumping space by said arcing products.

2. The circuit interrupter of cliam 1 in which:

a. said valve means comprises a movable valve member that is effective in one position to block said auxiliary passage and to allow free communication between said pumping space and said blast passage and is effective in another position to allow flow through said auxiliary passage and to block communication between said pumping space and said blast passage, b. means is provided for maintaining said movable valve member in said first position during low-current interruptions, c. and means responsive to the pressure of in the arcing region of arcing products developed during circuit interruption is provided for shifting said movable valve member to said other position in response to the relatively high pressures in the arcing region of the arcing products developed during a high-current interruption.

3. The circuit interrupter of claim 1 in which:

a. said one contact is mounted on a movable contact rod through which said blast passage extends, and b. said auxiliary passage means and said valve means are movable with said contact rod.

4. The circuit interrupter of claim 2 in which:

a. said one contact is mounted on a movable contact rod through which said blast passage extends, and b. said auxiliary passage means and said valve means are movable with said contact rod.

5. The circuit interrupter of claim 1 in which said valve means comprises:

a. first check valve means between said blast passage and said pumping space for blocking flow from said blast passage into said pumping space but allowing reverse flow, and b. second check valve means between said blast passage and said working space for allowing flow through said auxiliary passage into said working space when the pressure in the arcing region is high during a high-current interruption, but blocking flow from said working space through said auxiliary passage into said blast passage, even when the pressure in the arcing region is relatively low during the period around current zero during a high-current interruption.

6. The interrupter of claim 1 in which:

a. said piston is moved in an opposite direction during a contact-closing operation from its direction of movement during a contact-separating operation, thereby compressing gas in said working space during a contact-closing operation, and b. there is provided means effective near the end of a contact-closing operation for operating said valve means into a position that allows gas compressed in said working space by closing motion of said piston to flow through said valve means and said blast passage into said arcing region.

7. The interrupter of claim 1 in combination with means for venting said working space near the end of a contact-separating operation.

8. The interrupter of claim 6 in combination with means for venting said working space near the end of a contact-separating operation.

9. A gas-blast electric circuit interrupter of the puffer type comprising:

a. a pair of separable contacts, b. means operable during circuit interruption for moving one of said contacts relative to the other to separate said contacts and produce an arc therebetween in the region between said contacts, said arc developing arcing products varying in pressure generally as a direct function of the arcing current, c. a piston positively coupled to one of said contacts, d. means cooperating with said piston and defining a pumping space at one side of said piston adapted to contain arc-extinguishing gas that is compressed by motion of said piston during a contact-separating operation, e. means defining a blast passage through which gas compressed in said pumping space can flow into said arcing region to aid in extinguishing said arc, f. and valve means effective during a low-current interrupting operation to allow free communication between said pumping space and said blast passage, whereby during a low-current interrupting operation compressed gas from said pumping space can flow into said arcing region via said blast passage at a predetermined point during contact-separation, g. said valve means being effective when the pressure of said arcing products in the arcing region is high during a high-current interrupting operation to block free communication between said pumping space and said blast passage, thereby decreasing contamination of the gas in said pumping space by said arcing products so as to reduce the force required from an opening operator to produce contact-separation at the desired speed, h. a working space at the opposite side of said piston from said pumping space, said working space being in communication with said arcing region during at least a portion of an interrupting operation so that the high-pressure arcing products developed during high-current interruptions can enter said working space and thus assist in operating said piston and separating said contacts, h'. said blast passage extending from said pumping space to said arcing region via a path effectively bypassing said working space, i. and a nozzle of insulating material surrounding said contacts and having a portion serving as a cylinder for slidably receiving said piston and for defining said working space.

10. The interrupter of claim 9 in which said blast passage extends from said pumping space through the wall of said nozzle and discharges in a generally radial direction into said arcing region.

11. The interrupter of claim 9 in which means is provided within said working space for forcing the arcing products entering said working space to impinge against said piston and generally reverse their direction of flow following such impingement so as to effectively transfer momentum to said piston, thereby assisting in operating said piston and separating said contacts.

* * * * *